US008414408B2

(12) United States Patent
Nicora

(10) Patent No.: US 8,414,408 B2
(45) Date of Patent: Apr. 9, 2013

(54) APPARATUS FOR GOLF SIMULATION

(75) Inventor: Daniel Antonio Nicora, Temecula, CA (US)

(73) Assignee: Full Swing Golf, Inc., San Diego, CA (US)

( * ) Notice: Subject to any disclaimer, the term of this patent is extended or adjusted under 35 U.S.C. 154(b) by 2 days.

(21) Appl. No.: 12/884,727

(22) Filed: Sep. 17, 2010

(65) Prior Publication Data

US 2011/0070961 A1 Mar. 24, 2011

Related U.S. Application Data

(60) Provisional application No. 61/244,410, filed on Sep. 21, 2009.

(51) Int. Cl.
*A63B 67/02* (2006.01)

(52) U.S. Cl.
USPC ..... 473/156; 473/154; 473/155; 473/199

(58) Field of Classification Search ..... 473/154–156, 473/199
See application file for complete search history.

(56) References Cited

U.S. PATENT DOCUMENTS

| | | | | | |
|---|---|---|---|---|---|
| 2,894,750 | A | * | 7/1959 | Simjian | 473/190 |
| 2,942,517 | A | * | 6/1960 | Moon et al. | 359/451 |
| 3,072,410 | A | * | 1/1963 | Simjian | 473/154 |
| 3,091,466 | A | * | 5/1963 | Speiser | 473/155 |
| 3,625,510 | A | * | 12/1971 | Szigety | 472/75 |
| 3,655,203 | A | * | 4/1972 | Gretzky | 473/173 |
| 4,177,994 | A | * | 12/1979 | Lindquist | 473/156 |
| 5,333,874 | A | | 8/1994 | Arnold et al. | |
| 5,401,018 | A | * | 3/1995 | Kelly et al. | 473/430 |
| 5,419,565 | A | * | 5/1995 | Gordon et al. | 473/455 |
| 5,486,002 | A | * | 1/1996 | Witler et al. | 473/199 |
| 5,846,139 | A | | 12/1998 | Bair et al. | |
| 2004/0248662 | A1 | * | 12/2004 | Gobush et al. | 473/199 |
| 2005/0023763 | A1 | | 2/2005 | Richardson | |
| 2009/0042627 | A1 | | 2/2009 | Nicora | |

FOREIGN PATENT DOCUMENTS

| | | |
|---|---|---|
| JP | 08-182786 | 7/1996 |
| JP | 2004135706 | 5/2004 |
| JP | 2007038000 | 2/2007 |
| KR | 20-0274513 | 5/2002 |
| KR | 1020030044601 | 6/2003 |
| KR | 10-0434599 | 6/2004 |

OTHER PUBLICATIONS

Hubert Shum, et al., Tracking the Translational and Rotational Movement of the Ball Using High-Speed Camera Movies, 2005 IEEE International Conference on Image Processing, Sep. 11-14, 2005, pp. III-1084-87.

Toru Tamaki, et al., Measuring Ball Spin by Image Registration, The 10th Korea-Japan Joint Workshop on Frontiers of Computer Vision, 2004, pp. 269-274.

International Search Report and Written Opinion of the International Search Authority for International Application No. PCT/US2010/049309, dated May 19, 2011.

* cited by examiner

*Primary Examiner* — Michael Cuff
(74) *Attorney, Agent, or Firm* — Knobbe Martens Olson & Bear LLP

(57) ABSTRACT

A golf simulator allows a player to launch a golf ball towards a display surface that shows the future trajectory of the golf ball. In one embodiment, the display surface allows the golf ball to pass through it. In one embodiment, the simulator collects the golf ball after it passes through the display surface and returns it to the player.

19 Claims, 6 Drawing Sheets

APPARATUS FOR GOLF SIMULATION

RELATED APPLICATIONS

This application is claims the benefit of U.S. Provisional Application No. 61/244,410, filed Sep. 21, 2009, the entire content of which is incorporated herein by reference.

BACKGROUND OF THE INVENTION

1. Field of the Invention

The present invention relates generally to computer based golf simulators.

2. Description of the Related Art

Golf is a sport that is continuing to grow in popularity. One of golf's main attractions to enthusiasts is the continual challenge of improving one's game. To become an adept golfer and to maintain golfing proficiency, a significant amount of practice is required. However, few enthusiasts have the available time required to play full rounds of golf or to practice hitting golf balls at outdoor driving ranges. To solve this problem, many have found indoor golf simulators to be a viable alternative. Golf simulators have been introduced for providing an indoor facility in which a golfer can practice all aspects of the golfing game.

SUMMARY OF THE INVENTION

The system, methods, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of the Preferred Embodiments" one will understand how the features of this invention provide advantages over other golf simulators.

In one embodiment, a golf simulator in which a golf ball is launched toward a display surface, wherein the future trajectory of a golf ball is predicted and displayed on the display surface, the apparatus comprises a launch area, a computer that computes the predicted trajectory of the golf ball, and a display surface on which the predicted trajectory of the golf ball appears, wherein the display surface is configured to allow the golf ball to pass through the display surface.

In another embodiment, a golf simulator in which a golf ball is launched toward a display surface, wherein the future trajectory of a golf ball is predicted and displayed on the display surface, the apparatus comprises means for predicting trajectory of the golf ball, displaying means for displaying the predicted trajectory of the golf ball, and means for allowing the golf ball to pass through the displaying means.

DETAILED DESCRIPTION OF THE PREFERRED EMBODIMENT

The following detailed description is directed to certain specific embodiments of the invention. However, the invention can be embodied in a multitude of different ways as defined and covered by the claims. In this description, reference is made to the drawings wherein like parts are designated with like numerals throughout.

In one embodiment, a golf simulator allows a player to hit a golf ball in a launch area towards a display surface depicting a golf course, and the golf simulator then calculates the future trajectory of the golf. The calculated future trajectory of the golf ball may be shown on a display surface such that the golf ball is shown traveling down a fairway after a shot, for example. In one embodiment, the display surface allows the golf ball to pass through it. For example, the display surface may be made from a network of vertical and horizontal elastic bands. Such a display surface allows a golf ball to pass through the display surface while still creating a visually realistic view of the future trajectory of the golf ball.

Figure 1:
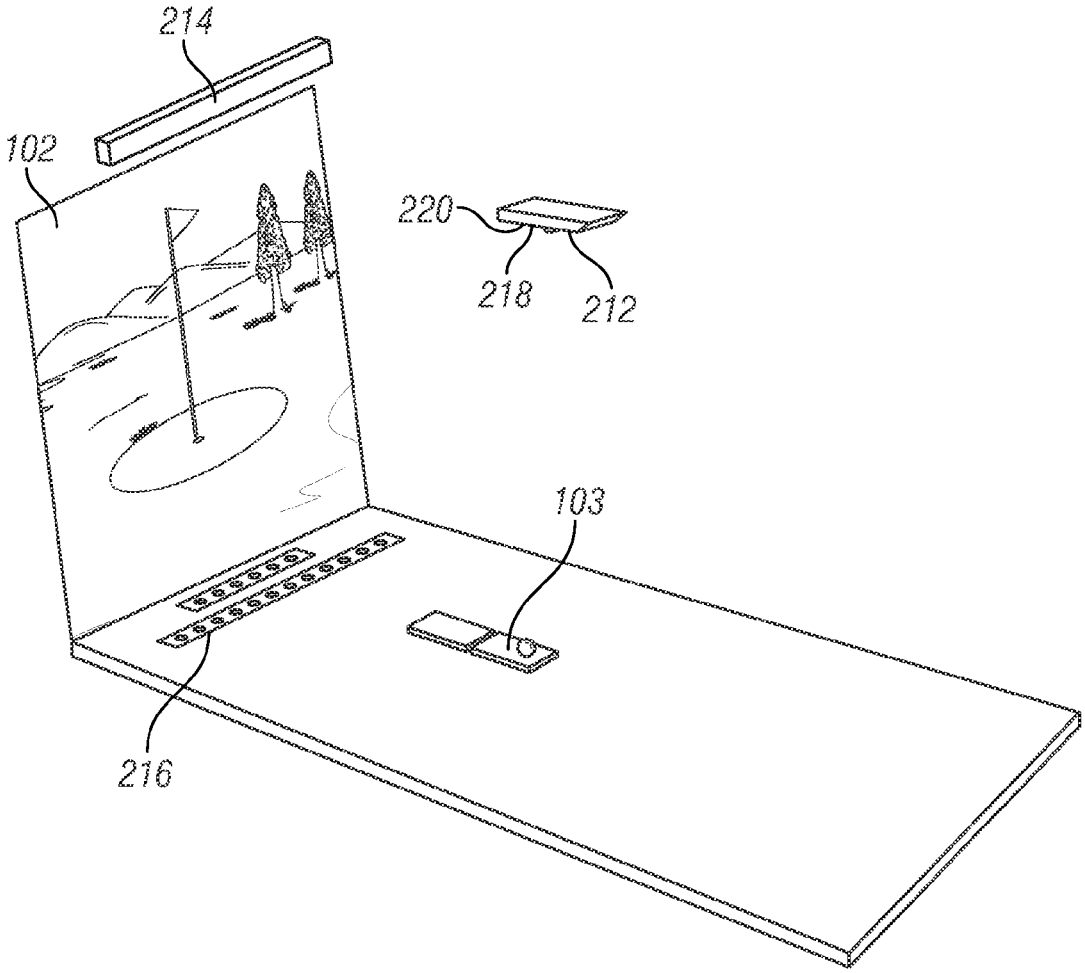
FIG. 1 is a diagram illustrating one embodiment of a golf simulator.

Aspects of the invention will now be described with reference to the Figures. Referring first to FIG. 1, a golf simulator is illustrated. Common characteristics of a golf simulator include a display surface 102 and a launch area 103. A golf ball may be accelerated from the launch area 103 towards the display surface 102. For example, a player could drive, pitch, or putt a golf ball towards the display surface 102. The display surface 102 may have an image thereon appropriate for the golf game being simulated. The display surface 102 may be made of a suitable material and surface to project an image upon it. In one embodiment, the image may be projected on the display surface 102 using a projector mounted in an area away from possible flight paths of the golf ball. In some embodiments, the golf simulator has an enclosure surrounding the display surface 102.

In one example, the image on the display surface 102 is a fairway, green, or other part of a golf course. In these embodiments, after the golf ball reaches the display surface 102, an image of the ball following a predicted trajectory is generated and shown on the display surface 102 to simulate a golf shot in the displayed golf course. In one embodiment, the display surface 102 displays a golf hole, and the display surface 102 displays the golf ball moving towards the golf hole based on the predicted trajectory of the golf ball. Once it is determined that the golf ball reached the golf hole after single or multiple golf swings, a new golf hole may be displayed on the display surface 102.

Figure 2:
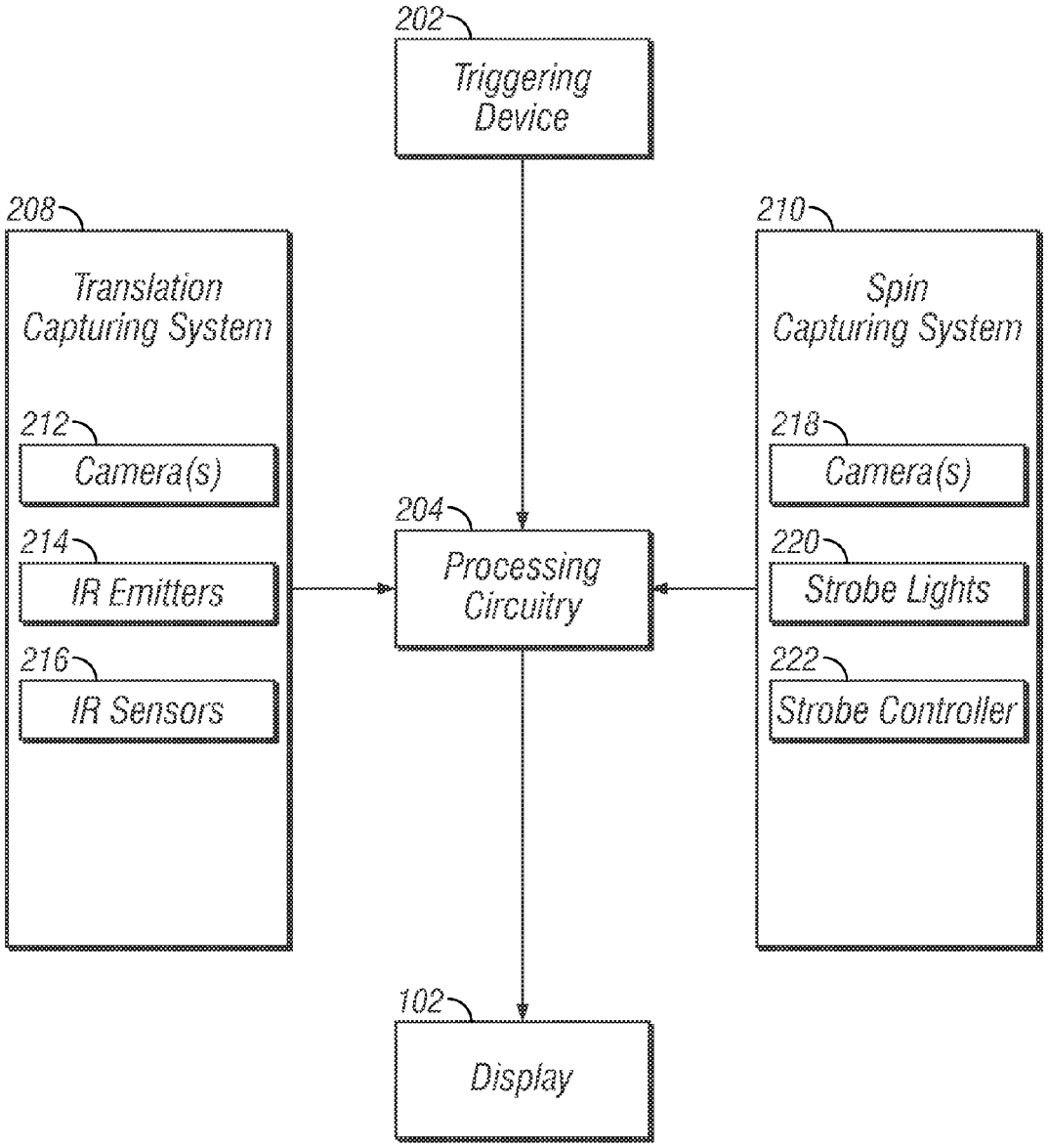
FIG. 2 is block diagram illustrating one embodiment of a trajectory generation system in a golf simulator.

FIG. 2 is a block diagram illustrating in further detail an apparatus for producing the predicted trajectory. The apparatus includes the display surface 102, a triggering device 202, a processing circuitry 204, a translation capturing system 208, and a spin capturing system 210. The triggering device 202 begins the operation of the simulator. The triggering device 202 detects when a golf ball leaves the launch area 103. For example, the triggering device may be a microphone that detects a sound indicative of a golf ball hit by a golf club.

Once the triggering device 202 detects that a golf ball has been hit, the golf simulator begins determining the future trajectory of the golf ball. Predicting the future trajectory of the golf ball requires the calculation of both translational velocity and rotational velocity. Thus, the simulator contains translation capturing system 208 and rotation capturing system 210. The spin capturing system 210 may be comprised of a single or multiple cameras 218 and a lighting system. The lighting system in one embodiment is comprised of a strobe controller 222 coupled to one or more strobe lights 220. The translation capturing system may contain, for example, one or more cameras 212, IR emitters 214, and IR sensors 216. In one embodiment, only one camera is used to perform the functions of both camera 212 and camera 218.

The processing circuitry 204 is configured to compute rotational and translational velocity based on information received from the translation capturing system 208 and the rotation capturing system 210. Based on the rotational and translational velocity, the processing circuitry 204 computes the future trajectory of the golf ball. The display surface 102 then shows the golf ball following the future trajectory calculated by the processing circuitry 204. In one embodiment, a computer houses the processing circuitry 204 and controls the simulation. From the computer, a player can select various options of game play which may include practice modes and golf course selection. Other configuration settings such as trigger timings, delays, and microphone sensitivity may also be controlled from the computer.

Referring back to FIG. 1, the IR sensors 216 are located between the launch area 103 and the display surface 102. The IR emitters 214 may be located such that the light emitted from the IR emitters 214 can be detected by at least one of the IR sensors 216. The camera 212 is positioned so that it can capture an image of the launch area 103. The strobe lights 220 may be positioned so that they provide light for the camera 218. The camera 218 may be located such that it can capture an image of the golf ball as it travels from the launch area 103 to the display surface 102.

The processing circuitry 204 calculates the translational velocity of the golf ball. The processing circuitry 204 may determine the initial position of the golf ball using images captured by the camera 212. A triggering device 202 can be used to determine when the golf ball is launched. Thus, the triggering device detects the time at which the golf ball left the initial position. The processing circuitry 204 compares the initial position and the time determined by the triggering device to the position and time that the golf ball passes through a set of IR emitters 214 and IR sensors 216.

The processing circuitry 204 also calculates the rotational velocity of the golf ball. A camera 218 may be used to determine the spin of the golf ball. The camera 212 may capture multiple images and compare the golf ball's 104 position in the images to determine the golf ball's 104 spin. In order to determine the time between images, strobe lights 220 and a strobe controller 222 may be used. A strobe controller may control a set of strobe lights 220 so that the lights strobe at regular intervals. The strobe lights 220 illuminate the golf ball so that clean images can be taken. Thus, the processing circuitry 204 may compute the golf ball's 104 rotational velocity using the two rotational positions determined from two camera images and the time between strobes. The strobe is preferably an IR strobe so that it is not visible to the user.

Based on the calculated rotational velocity and translational velocity, the processing circuitry 204 calculates the projected trajectory of the golf ball. A system using strobe lights, a camera, and IR emitters for determining rotational and translational velocity is described in more detail in U.S. Application No. 61/145,683 filed on Jan. 19, 2009, and the application is incorporated by reference.

A wide variety of systems may be used to compute translational and rotational velocities for producing a predicted golf ball trajectory, and the above described system is only one example. Other known systems use sensors to determine the speed and orientation of the club face as it strikes the ball.

Conventional systems use a solid display. When the golf ball hits the display, it bounces back, causing extraneous noise and producing a result that is not particularly similar to playing actual golf. Some systems use this rebound to gather additional information about the ball trajectory. Advantageous embodiments described herein, however, incorporate a display surface that is configured so that the golf ball may pass through it. In one embodiment described in more detail below, the display surface 102 may be formed from a set of bands of material that allow the golf ball to pass through the display surface 102.

Figure 3:
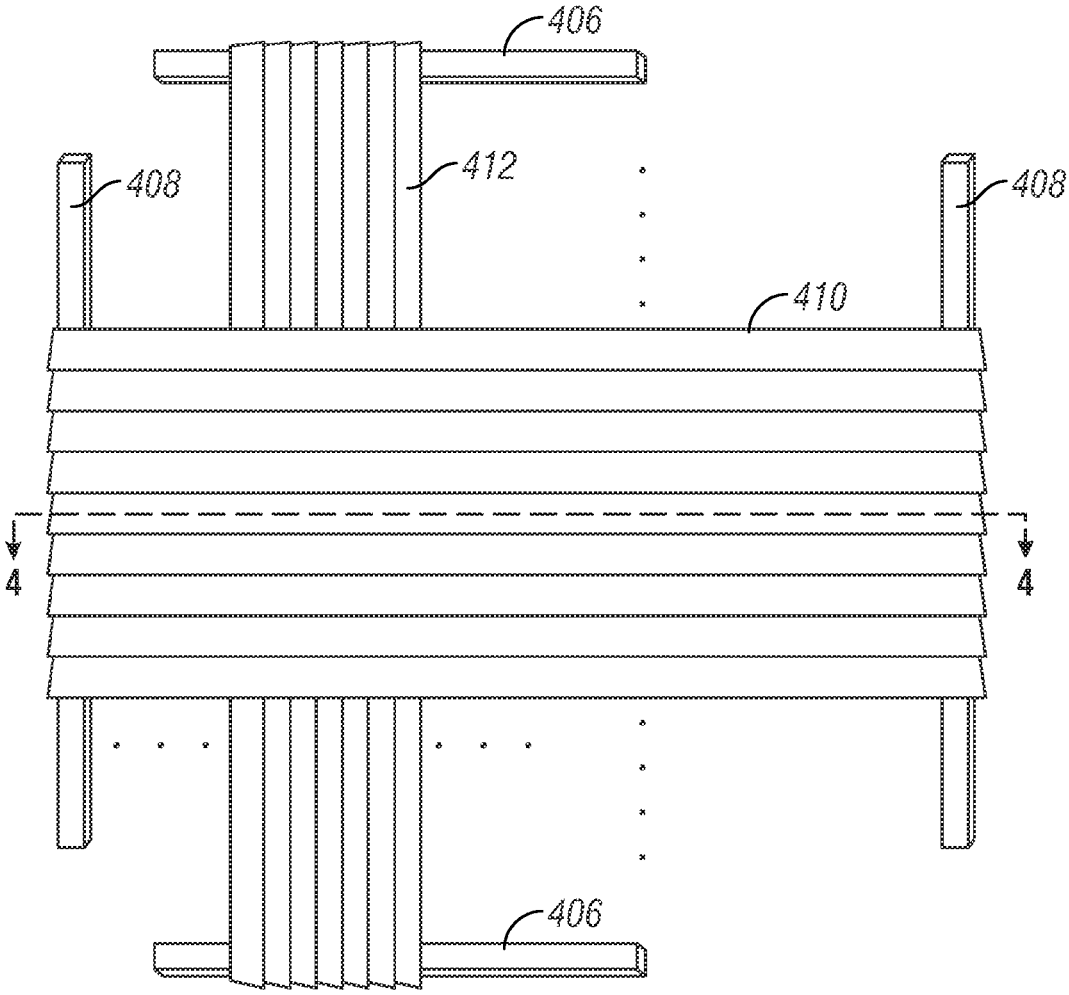
FIG. 3 is a diagram illustrating one embodiment of a golf simulator display surface comprising elastic bands.

FIG. 3 is a diagram illustrating one embodiment of the golf simulator display surface 102 in which the golf ball may pass through the display surface 102. In one embodiment, the display surface 102 has horizontal bands 410 and vertical bands 412. The horizontal bands 410 may be positioned approximately horizontal, and the vertical bands 12 may be positioned approximately vertical. However, the bands may be positioned in any configuration, including diagonally. The horizontal bands 410 and vertical bands 412 may be designed so that an image may be projected on the bands, but the golf ball may pass through a small space created between the bands as the golf ball strikes the surface. The horizontal bands 410 and vertical bands 412 may be made from any suitable material, such as cloth or plastic. Elastic cloth bands normally used in clothing applications has been found suitable. In one embodiment, the horizontal bands 410 are made from a different material than the vertical bands 412.

Figure 4:
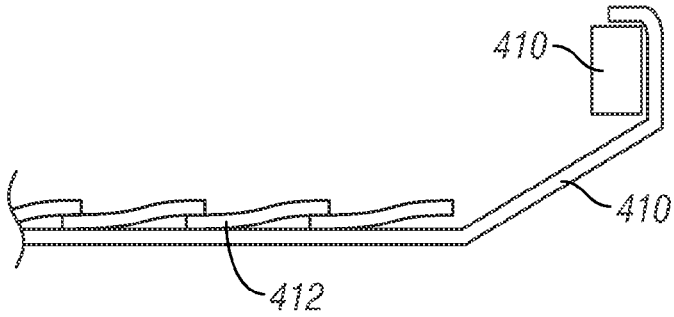
FIG. 4 is a diagram illustrating the golf simulator display surface of FIG. 3 in top cutaway view along lines 4-4 of FIG. 3.

The display surface 102 may include only horizontal bands 410, only vertical bands 412, or both horizontal bands 410 and vertical bands 412. In one embodiment, the display surface 102 includes more than one set of horizontal bands 410 or vertical bands 412, and in another embodiment, as shown in FIGS. 3 and 4, the display surface 102 includes one set of horizontal bands 410 and one set of vertical bands 412. The display surface 102 may include the horizontal bands 410 and vertical bands 412 in only a portion of the display. If multiple sets of bands are used, any set of bands may be in the front portion of the display closest to the launch area. For example, either the horizontal bands 410 or the vertical bands 412 may be placed in front of the other set. In one embodiment, it has been found that the golf ball may more easily pass through the set of horizontal bands 410 and vertical bands 412 if the horizontal bands 410 are positioned in front of the vertical bands 412. Portions of the horizontal bands 410 and vertical bands 412 may also be weaved together for all or a portion of the display surface 102 so that one set of the bands is not entirely in front of the other set of bands.

The horizontal bands 410 and vertical bands 412 may be supported by any suitable means. For example, in FIG. 3, the display surface 102 has horizontal supports 406 and vertical supports 408. The horizontal bands 410 may be connected to support the first vertical support 408 on one end and to the second vertical support 408 on the other end, and each individual vertical band 412 may connect to a first horizontal support 406 on one end and to a second horizontal support 406 on the other end. The horizontal bands 410 and vertical bands 412 may be connected to supports 406 and 408 using any suitable manner of attachment, such as staples, clips, or velcro.

The supports 406 and 408 may form any suitable display shape, such as a rectangular or circular shape. In another embodiment, there are no distinct horizontal and vertical supports. For example, the bands may attach to a wall or the edges of a golf simulator enclosure. The tension across all of the horizontal bands 410 may be approximately the same to prevent any drooping in order for the display surface 102 to appear uniform. Likewise, the tension across all of the vertical bands 412 may also be approximately the same.

The individual horizontal bands 410 and vertical bands 412 may be positioned in any manner that allows the golf ball to pass through them. Each horizontal band 410 may be positioned close enough to the next horizontal band 410 so that the display surface looks like a single image. In one embodiment, the horizontal bands 410 overlap one another. For example, the horizontal bands 410 may be positioned to overlap enough that there are no gaps in the image on the display surface 102, but so that the overlap is small enough that the golf ball may easily pass through them. The vertical bands 412 may also be positioned next to each other and may be positioned so that the vertical bands 412 overlap with one another. In one embodiment, each horizontal band 410 overlaps about one third of the next horizontal band 410, and each vertical band 412 overlaps about one third of the next vertical band 412. It is advantageous if the overlap is less than about one half the band width.

The width of each of the horizontal bands 410 and vertical bands 412 may be designed so that they are wide enough so the display surface looks cohesive, but thin enough that the golf ball may pass through them. In one embodiment, the width of the horizontal bands 410 and vertical bands 412, where the width is the distance across the display surface 102 facing the golfer, is between one and three inches thick. In one embodiment, the multiple horizontal bands 410 are not all the same width. In another embodiment, the multiple vertical bands 412 are not all the same width. The horizontal bands 410 may also be a different width than the vertical bands 412.

FIG. 4 is a diagram illustrating one embodiment of a golf simulator display surface. In one embodiment, the supports for the front set of bands are positioned behind the supports for the rear set of bands. For example, in FIG. 2, the vertical supports 408 are positioned behind the horizontal supports 406 such that the vertical bands 412 exert a slight pressure on the horizontal bands 410. In another embodiment, the horizontal supports 406 may be positioned behind the vertical supports 408 with the horizontal bands 410 positioned behind the vertical bands 412 such that the horizontal bands 410 exert pressure on the vertical bands 412. This positioning may keep the front set of bands more stable and prevent them from drooping. As a result, the image displayed on the front set of bands may appear essentially as if the display surface were a solid sheet of material.

Figure 5:
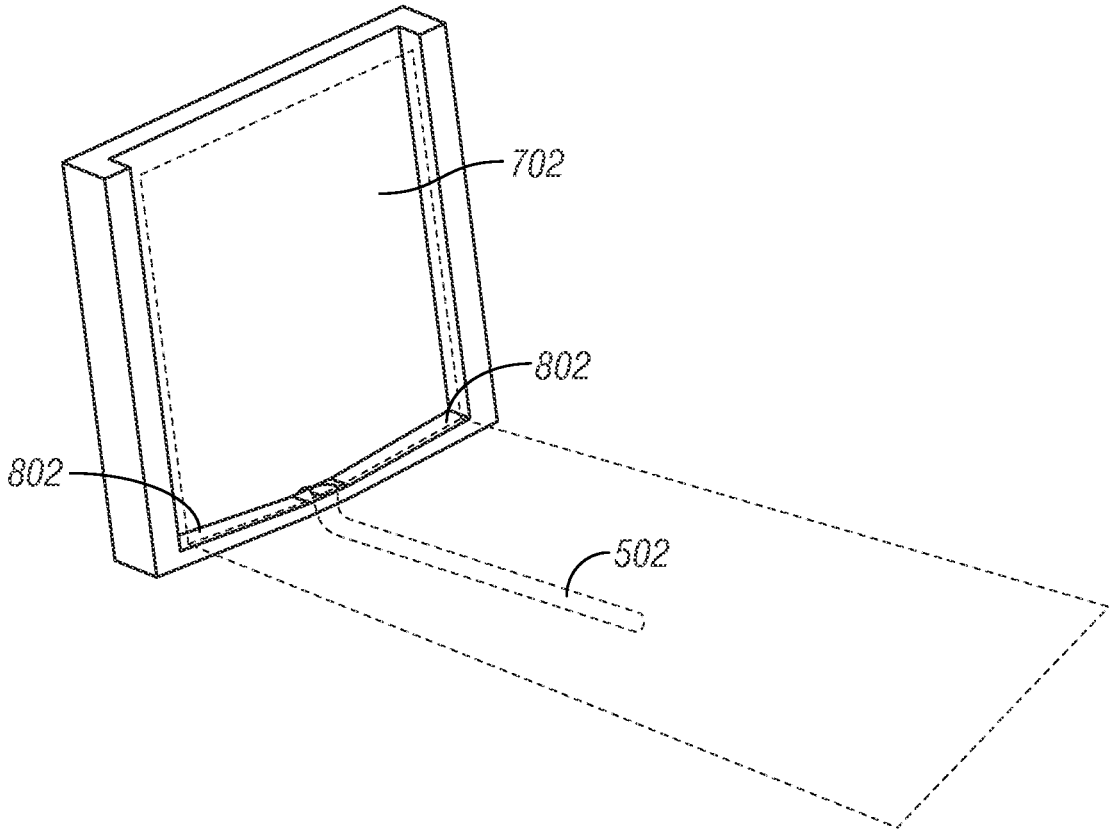
FIG. 5 is a diagram illustrating one embodiment of a golf simulator ball catcher.

FIG. 5 is a diagram illustrating one embodiment of a golf simulator. In one embodiment, the golf simulator is designed so that the golf ball is stopped after passing through the display 102. For example, a ball catcher 702 may block or catch the golf ball after it passes through horizontal bands 410 and vertical bands 412. The ball catcher 702 may be positioned so that the horizontal bands 410 and vertical bands 412 are between the launch area 103 and the ball catcher 702. The ball catcher 702 may be made from any suitable material, such as foam or netting. In one embodiment, once the golf ball hits the ball catcher 702, the golf ball is guided by guiding regions 802. For example, the guiding regions 802 may guide the golf ball to a tunnel 502 under the golf simulator floor. The golf simulator may also contain a mechanism to kick the ball back up above the golf simulator floor once the golf ball reaches the launch area 103. In another embodiment, the golf ball is returned to the player without the golf ball being sent under the simulator or flooring. For example, the golf ball may be guided back to the player in a tunnel above the golf simulator floor or may be guided back to the player by projecting it back to the launch area 103 from near the display surface 102.

Figure 6:
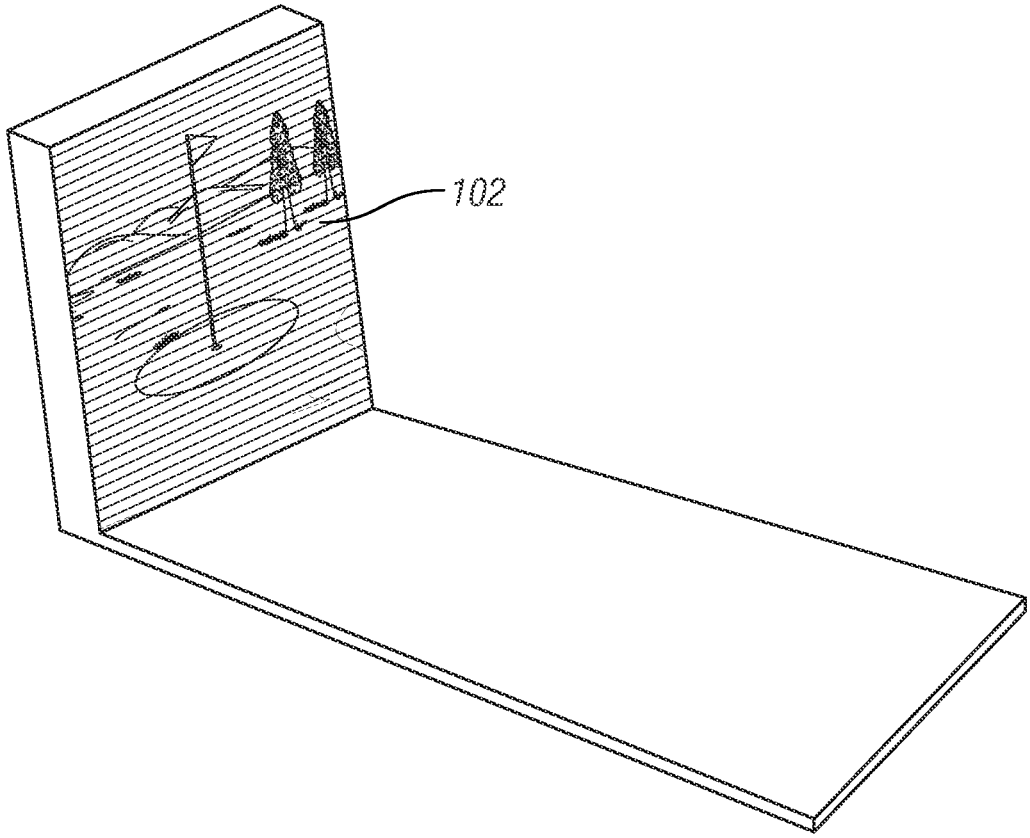
FIG. 6 is a diagram illustrating one embodiment of a golf simulator display surface comprising elastic bands.

FIG. 6 is a diagram illustrating a golf simulator with a display surface as illustrated in Figures 3 and 4. FIG. 6 shows the display surface 102 formed with the horizontal bands 410 in front of the vertical bands 412, and an image of a fairway is project upon the horizontal bands 410 which form the front of the display surface 102. The remaining portions of the golf simulator illustrated, for example, in FIG. 1 have been omitted from FIG. 6 for clarity.

Figure 7:
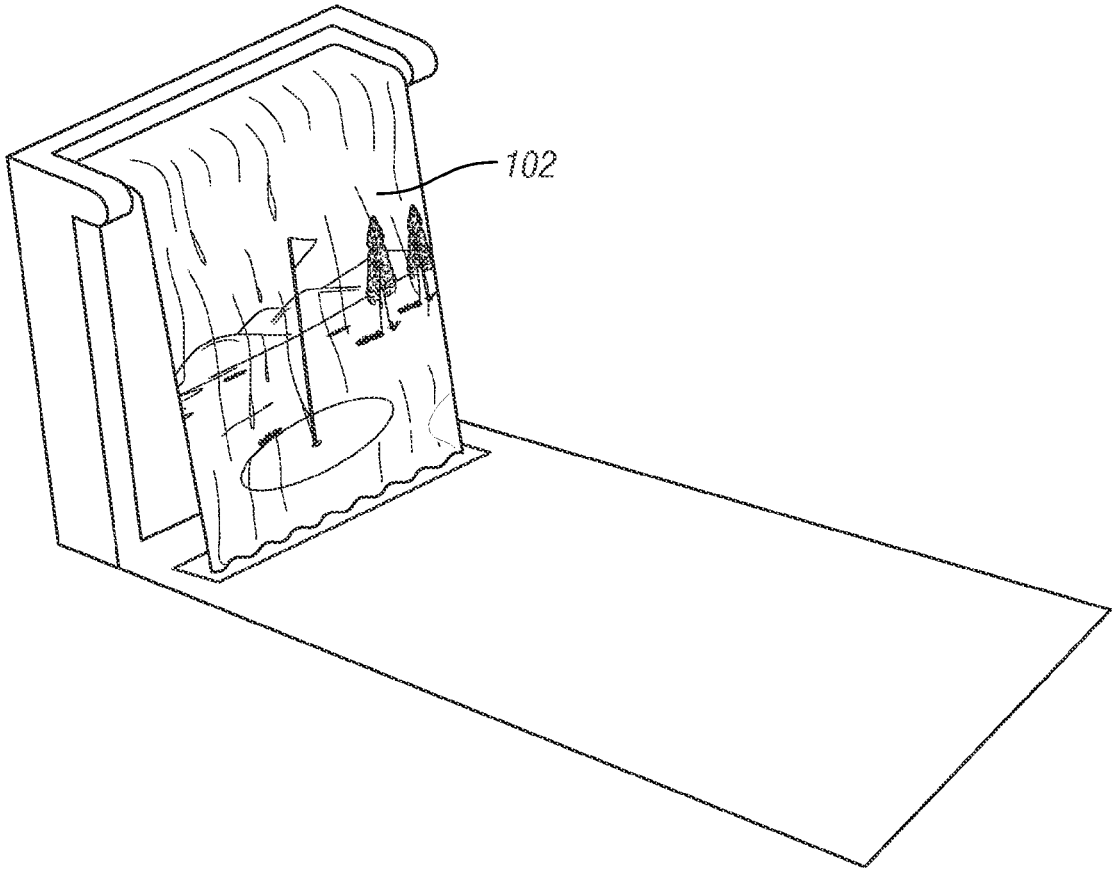
FIG. 7 is a diagram illustrating one embodiment of a golf simulator display surface comprising a liquid sheet.

It will be appreciated that other display surfaces that allow the ball to pass through can be utilized. FIG. 7 is a diagram illustrating another embodiment of a golf simulator with such a display surface. For example, the display 102 may be made of a fluid material, as shown in FIG. 7. The flow of the fluid may be controlled so that it passes as a waterfall at the top of the display surface 102 such that it forms a sheet facing the launch area 103. The fluid may be collected at the bottom of the display surface 102 and recycled to that it may be used again to flow down the front of the display surface 102. An image of the golf course and the golf ball traveling through the golf course may be displayed on the fluid. When the golf ball is hit, it may easily pass through the fluid display surface 102. For this embodiment, it is advantageous if the fluid has higher viscosity than water, and is also highly reflective. Thus, various types of oils and pigments could be provided in the fluid to optimize its color and flow properties for use as a display surface.

Although golf simulation is a particularly advantageous application of the inventions described herein it will be appreciated that other sports simulations could be performed in accordance with the principles described. For example, a tennis ball could be served towards an image of a tennis court.

Those of skill will recognize that the various illustrative logical blocks and algorithm steps described in connection with the embodiments disclosed herein may be implemented as electronic hardware, software stored on a computer readable medium and executable by a processor, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present development.

While the above detailed description has shown, described, and pointed out novel features of the development as applied to various embodiments, it will be understood that various omissions, substitutions, and changes in the form and details of the device or process illustrated may be made by those skilled in the art without departing from the spirit of the development. As will be recognized, the present development may be embodied within a form that does not provide all of the features and benefits set forth herein, as some features may be used or practiced separately from others. The scope of the development is indicated by the appended claims rather than by the foregoing description. All changes which come within the meaning and range of equivalency of the claims are to be embraced within their scope.

What is claimed is:

1. A golf simulator in which a golf ball is launched toward a display surface, wherein a future trajectory of a golf ball is predicted and displayed on the display surface, the apparatus comprising:

a launch area in proximity to a display surface such that when the golf ball is launched the golf ball passes through the display surface;

a computer that computes the predicted trajectory of the golf ball;

the display surface is configured to display the predicted trajectory of the golf ball; and wherein, the display surface comprising a first plurality of elastic bands supported at least at a first end and a second end to cause tension across the first plurality of elastic bands that prevents the first plurality of elastic bands from drooping.

2. The apparatus of claim 1, further comprising:

one or more strobe lights;

a strobe controller coupled to the strobe lights;

a triggering device coupled to the strobe controller;

at least one camera configured to capture images viewed by the strobe lights;

an array of emitters for transmitting electromagnetic radiation;

an array of receivers, wherein at least one of the receivers is positioned to receive light from at least one of the emitters and to generate a signal in response thereto; and wherein the computer computes the rotational velocity of the golf ball based at least in part on the captured images and computes the translational velocity based at least in part on the captured images and the signal.

3. The apparatus of claim 1, wherein the first plurality of elastic bands are adjacent to one another.

4. The apparatus of claim 1, wherein the first plurality of elastic bands are positioned horizontally.

5. The apparatus of claim 1, wherein the first plurality of elastic bands are positioned vertically.

6. The apparatus of claim 1, wherein the first plurality of elastic bands are positioned behind a second plurality of elastic bands.

7. The apparatus of claim 1, wherein at least one of the first plurality of elastic bands are attached to supports with staples, clips, or velcro.

8. The apparatus of claim 1, wherein at least one of the first plurality of elastic bands comprise elastic textile material.

9. The apparatus of claim 1, wherein at least one of the first plurality of elastic bands are between 1 and 3 inches wide.

10. The apparatus of claim 1, wherein at least one of the first plurality of elastic bands overlap with one another.

11. The apparatus of claim 10, wherein each of at least one of the first plurality of elastic bands overlaps approximately one third of the adjacent band.

12. The apparatus of claim 10, wherein at least one of the first plurality of elastic bands overlaps less than one half of the adjacent band.

13. The apparatus of claim 1, further comprising a ball catcher, wherein the display surface is positioned between the launch area and the ball catcher.

14. The apparatus of claim 13, wherein the ball catcher comprises foam.

15. The apparatus of claim 13, wherein the ball catcher comprises netting.

16. The apparatus of claim 13, further comprising a ball return path for returning the golf ball to the launch area.

17. The apparatus of claim 1, wherein the tension of each of at least one of the first and second plurality of bands attached is approximately equal.

18. The apparatus of claim 1, wherein at least one of the first plurality of elastic bands extends in a first direction and at least another of the first plurality of elastic bands extends in a second direction that is different than the first direction.

19. A method of playing simulated golf comprising:

providing a computer launching a golf ball such that the golf ball passes through a display surface;

computing, via the computer, a predicted trajectory of the launched golf ball;

displaying an image of a golf course scene and the predicted trajectory of the launched golf ball on the display surface; and the display surface comprising a first plurality of elastic bands supported at least at a first end and a second end to cause tension across the first plurality of elastic bands that prevents the first plurality of elastic bands from drooping.

* * * * *

UNITED STATES PATENT AND TRADEMARK OFFICE

CERTIFICATE OF CORRECTION

PATENT NO. : 8,414,408 B2
APPLICATION NO. : 12/884727
DATED : April 9, 2013
INVENTOR(S) : Daniel Antonio Nicora It is certified that error appears in the above-identified patent and that said Letters Patent is hereby corrected as shown below:

In the Claims

In column 7 at line 3, In Claim 1, change "a golf ball" to --the golf ball--.

In column 8 at line 22, In Claim 17, change "of claim 1," to --of claim 6,--.

Signed and Sealed this
Twenty-third Day of September, 2014

Michelle K. Lee

Michelle K. Lee
*Deputy Director of the United States Patent and Trademark Office*